US005556819A

United States Patent [19]

Bar-Ilan

[11] Patent Number: 5,556,819

[45] Date of Patent: Sep. 17, 1996

[54] METHOD OF MAKING A FLAME ARRESTING AND CONTAMINANT-ABSORBING FILTER APPARATUS

[75] Inventor: Amiram Bar-Ilan, Brookline, Mass.

[73] Assignee: Prototech Company, Needham, Mass.

[21] Appl. No.: 425,604

[22] Filed: Apr. 20, 1995

Related U.S. Application Data

[62] Division of Ser. No. 885,185, May 19, 1992, Pat. No. 5,431,887.

[51] Int. Cl.[6] ..... B01J 38/48; B01J 20/10; B01J 29/06

[52] U.S. Cl. ..... 502/22; 423/245.3; 502/73; 502/355

[58] Field of Search ..... 502/73, 439, 22, 502/25, 355; 423/245.3

[56] References Cited

U.S. PATENT DOCUMENTS

| | | | |
|---|---|---|---|
| 3,978,777 | 9/1976 | Nett | 98/115 K |
| 4,686,198 | 8/1987 | Bush et al. | 502/25 |
| 4,711,009 | 12/1987 | Cornelison et al. | 29/157 R |
| 5,094,222 | 3/1992 | Fukuda et al. | 126/19 R |

*Primary Examiner*—Michael Lewis
*Assistant Examiner*—Christina Annick
*Attorney, Agent, or Firm*—Scott R. Cox

[57] ABSTRACT

In a catalytic assembly having an oxidation catalytic unit disposed above the broiling area of a fat-food broiler for enabling the catalytic oxidation of volatile broiling smoke organic contaminants, a low pressure drop open-pore metallic flame-arresting filter screen disposed between the broiling area and the catalytic unit and substantially completely overlying the broiling area and containing upon the screen an adherent coating comprising a high surface area inorganic oxide adsorbent and an inorganic binder therefor, the coating serving to adhere salt, phosphorous and other catalyst-poisoning compounds in the broiling emissions. Preferred methods of coating and broiler flame-arresting use are described.

4 Claims, No Drawings

METHOD OF MAKING A FLAME ARRESTING AND CONTAMINANT-ABSORBING FILTER APPARATUS

This is a divisional of application Ser. No. 07/885,185 filed on May 19, 1992 now U.S. Pat. No. 5,431,887.

The present invention relates to catalytic assemblies for the oxidative abatement of fumes, including aerosol-bearing smoke generated in food cooking, more particularly in the broiling of meats and the like, and which is accompanied by fat-combusting flames, as well.

BACKGROUND

The art is replete with catalytic converters or oxidation units proposed generally for closed cooking ovens and the like, including for "pyrolyric" self-cleaning, such as in U.S. Pat. Nos. 3,428,435; 3,536,457; and 3,962,561.

In exhausting ovens, in addition to the use of catalytic converters positioned in the oven, it has also been proposed to employ between the product-to-be-cooked and an oxidizing porous catalytic converter layer of layers in the exhaust path, a hot porous metal or ceramic first layer that intercepts the oil fumes and droplet components produced by the cooking and circulated to the exhaust under fan pressure, such first layer seeming to effect the decomposing of such components, as described, for example, in U.S. Pat. No. 4,113,439, while dispersing the oil fumes uniformly over the subsequent catalytic unit.

Such and similar converters have not, however, adequately solved the problems of run-time exhausting and venting of environmentally clean effluents in the different type of apparatus involved in conveyor-operated broilers for so-called "fast food" restaurants and the like. In such apparatus, successive servings of meats and fowl are charbroiled or fried in a continual production line, such as hamburgers, chicken parts and similar food, and in apparatus of the type disclosed, for example, in U.S. Pat. No. 3,646,878 and the like. Such conveyor apparatus has rather demanding environmental emission regulation requirements underlying the required purging and exhausting of the cooking effluent, while also preventing the rapid poisoning of the catalytic converters by components in the cooking effluent. The emissions from, for example, the broiling of fatty hamburgers and the like contain carbon monoxide, organic vapors, aerosols and oily fats, proteins and/or carbohydrates as pollutants for the environs—such constituting all of environmental, health and fire hazards.

In present practice, these problems are somewhat alleviated by diluting the smoke with large amounts of air fan-blown into and through the kitchens and exhausted through hoods and chimneys to the external environment, requiring costly heating and cooling air handling equipment. Such operation, moreover, does not prevent condensation and building up of aerosols in hoods and chimneys, but merely shifts the same amount of air pollutants, including objectionable odors as well, from indoors to the outdoors.

Exhausting chimneys have also been proposed, provided with a small honeycomb ceramic and supplementarily heatable (600° C.) noble metal catalyst to burn the cooking vapors and yield water vapor and carbon dioxide, as described, for example, in U.S. Pat. No. 4,516,486. Catalytic structures of this type are described, also, in U.S. Pat. Nos. 4,102,819 and 4,900,712 of common assignee herewith. A usual feature in the art, indeed, has been the funneling of the cooking smoke from a large fully enclosed cooking area to a small catalyst. The need therefor arose from the sporadic non-uniform smoke release, including practically uncontrollable bursts; and, for example, in broiling, from irregular grease flaming. As pointed out in the before-mentioned U.S. Pat. No. 4,113,439, to the contrary, for efficient operation of the catalytic unit, a uniform flow of volatile preferably aerosol-free contaminants is required to attain substantially complete catalytic oxidation effects. Typically, this has required an expensive system involving an enclosed complex cooking apparatus provided with fans and/or heat distributors, or even extra heaters, as above described. Regardless of cost, moreover, such systems are not readily applicable for use with existing open-top broilers or fryers such as are commonly used under hoods in restaurants, additionally inducing undesirable changes in heat distribution which affect adversely the quality of the food, being thus counterproductive.

While the before-mentioned concept of a first hot porous low pressure metal or ceramic screen for intercepting the oil fumes and dispersing the same over the subsequent catalytic unit is indeed useful with such charbroiler or similar conveyor-line broilers with which the present invention is largely concerned, such cannot of itself protect the subsequently positioned catalysts from being poisoned by finely divided solid inorganics, including particularly salt (e.g. sodium chloride and potassium chloride) and oxides of phosphorous resulting from the decomposition of phospholipids and entrained in the smoke and deposited, at least in substantial part, upon the catalyst.

It is to the solution of this and related problems particularly of concern with conveyer-line and similar charbroiler type apparatus and the like that the improvement of the present invention is primarily concerned, it having now been discovered that if such initial dispersing screen is not just of metal or ceramic, but is appropriately coated and also dimensioned to overlie substantially the complete broiling area (say from about three-quarters to one and a quarter the broiling area), such can admirably simultaneously serve markedly to adsorb and entrap such deleterious inorganics without at all impairing its oil fume and flame interception, arresting and dispersing functions, and can thus greatly reduce catalyst poisoning, increasing the catalyst life.

OBJECTS OF INVENTION

It is accordingly an object of the present invention to provide a new and improved method of and apparatus for adsorbing inorganic particles in broiler flame and smoke through a novel adherent coating applied to an open-pore metallic flame screen arrester or filter coated with an appropriate coating and positioned between the broiling area and smoke-oxidation catalyst and of dimensions largely overlying the broiling area.

A further object is to provide a novel thin low pressure drop filter formed of an open-pore metallic flame arrester screen bearing such a strongly adherent coating that comprises a high surface area inorganic oxide adsorbent and an inorganic binder therefor.

Other and further objects will be explained hereinafter and are more particularly delineated in the appended claims.

SUMMARY

In summary, however, from one of its viewpoints, the invention embraces in a catalytic assembly having an oxidation catalytic unit disposed above the broiling area of a fat-food broiler for enabling the catalytic oxidation of volatile broiling smoke organic contaminants, a low pressure drop open-pore metallic flame-arresting filter screen disposed between the broiling area and the catalytic unit and substantially overlying the complete broiling area, the screen being provided with an adherent coating comprising a high surface area inorganic oxide adsorbent and an inorganic binder therefor, that adheres salt, phosphorous and other catalyst-poisoning compounds in the broiling emissions while the screen disperses the broiling flame.

Preferred and best mode flame arresting coated filter designs and coatings are now presented.

DESCRIPTION OF PREFERRED EMBODIMENT(S) INVENTION

Since the invention resides in large part upon the recognition and discovery of the synergistic catalyst-poisoning prevention by adsorption of an appropriate chemical coating upon a porous filter for flame arresting and cooking oil and smoke dispersing, and the effects of such chemical adsorption cannot be readily shown in a drawing, no drawings have been provided; it being considered adequate to illustrate the invention by word description.

Specifically, however, the invention involves adhering, by means of an inorganic binder, a coating on a porous metallic or similar substrate serving as a flame arrester and dispersing screen, such as an open pore screen or an expanded metal sheet or the like, a strongly adhering coating containing a high surface area inorganic oxide component such as, preferably, alumina or a zeolite, capable of adsorbing and retaining even small amounts of very finely divided or particulate salts and phosphor compounds in the hot broiler emissions as they are funnelled or otherwise pass from the broiling area upward through the porous flame arrester and distributer to and through a catalytic oxidation unit to the external environs, as described in the earlier referenced patents.

The following example illustrates a preferred method of preparation of such a novel coated flame arrester-and-adsorbing screen of this invention; it being understood that those skilled in the art of metal coating may also employ other methods without departing from the scope of the invention.

An expanded metal #304 stainless steel screen (8 mesh and 18"×24" in size) is heated for about one hour at an elevated temperature of about 700° C. in an oxidizing atmosphere. It is then immersed for one minute in 10,000 ml of a substantially electrolyte-free aqueous slurry containing 500 g/l of gamma alumina (200 $m^2/g$) and about 75 g/l of colloidally dispersed ceria, similarly to, though for a somewhat different purpose than, that described in U.S. Pat. No. 4,900,712 of common assignee herewith. The screen is then removed from the slurry and excess slurry within the pores of the screen is removed by blow out with pressurized air. The coated screen is then heated for about three hours at 550° C., whereby the coating is stabilized and firmly adhered to the screen.

This process is repeated twice. The final active/coating amounts to 5% by weight of the original weight of the screen.

While the alumina coating material and the ceria binder are preferred components of the filter coating, other inorganic oxide adsorbents, especially silica zeolites, and other binders, such as zirconia or titania, are also suitable for the purposes of the invention.

In the process of bonding the adsorbent to the screen at high temperatures for extended periods of time, its surface area becomes substantially decreased. In the case of an alumina having a surface area of ca. 200 $m^2/g$, for example, when suspended in the slurry, its surface area is reduced by a factor of five to ten after completion of the high temperature bonding process. Surprisingly, however, it has been found that the alumina has nonetheless retained its capability to adsorb salts and phosphorus compounds.

Turning now to the utilization of the coated flame arresting screen and adsorber of this invention, when used between the broiling area and the catalytic oxidizer unit in the effluent path, the mitigating against catalyst poisoning has been found to be quite remarkable, with the useful life of the customary noble metal of the catalyst being found to be extended between three and ten times that attained with an uncoated screen, such as has been described in the before-referenced U.S. Pat. No. 4,113,439. When the coating was analyzed after 500 to 1000 hours of operation, the adsorbed presence of salt (NaCl) and a phosphorus oxide on the coating was indeed identified.

In practice, the used filter can be regenerated by washing, including the removal of the phosphorus-containing oxides, by an alkali solution, for example, thus minimizing subsequent breakthrough of this irreversible catalyst poison. Alternately, upon removal of the salt by a water wash, the "spent" filter, which is saturated with inorganics, can be rejuvenated by recoating it once or even twice in accordance with the procedure of the above example, even without removing the residual underlying adhered phosphorus compound-bearing layer underneath. It is evidently very inexpensive, relative to replacing the precious metal-bearing catalyst, to replace the coated filter of this invention periodically, especially after repeated uses thereof.

Further modifications will occur to those skilled in this art and such are considered to fall within the spirit and scope of the invention as defined in the appended claims.

What is claimed is:

1. A method of producing a flame-arresting filter for use in catalytic broiler smoke abatement assemblies, that comprises surface-oxidizing a stainless steel open pore screen at an elevated temperature; immersing the screen in a substantially electrolyte-free aqueous slurry containing an adsorbent selected from the group consisting of alumina and a zeolite adsorber and containing colloidally dispersed ceria binder; freeing the open pores of the screen from excess slurry; and heating the slurry-coated screen to cause the adsorbent coating to become stabilized and firmly bonded and adhered to the screen by the binder.

2. The method of claim 1 wherein the surface oxidation of the screen is carried out at a temperature of about 700° C. and for about an hour, and wherein the slurry contains about 500 g/l of suspended adsorbent and about 75 g/l of colloidal ceria, and the wet slurry-coated screen is heated to about 550° C. for several hours.

3. The method of claim 1 and in which the further step is performed of reactivating the flame-arresting filter after use when it has become saturated with said adsorbed salts and phosphorus compounds, comprising the step of removing salts by a water wash, drying the filter, and applying further adsorbent coating thereto.

4. The method of claim 1 and in which the adsorbed phosphorus compounds are removed by an alkali wash and the adsorbed salts by a water wash.

* * * * *